United States Patent [19]

Norvell

[11] Patent Number: 4,507,093

[45] Date of Patent: Mar. 26, 1985

[54] BUOY DEVICE FOR AUTOMATIC RAISING OF SUBMERGED OBJECTS

[76] Inventor: James H. Norvell, P.O. Box 3086, Juneau, Ak. 99803

[21] Appl. No.: 499,335

[22] Filed: May 31, 1983

[51] Int. Cl.[3] ..... B63G 8/22

[52] U.S. Cl. ..... 441/2; 43/100; 43/102; 251/297; 251/323; 441/30

[58] Field of Search ..... 251/323, 297; 441/1, 441/2, 6, 7–10, 21, 30, 31; 43/100, 102–104; 114/54

[56] References Cited

U.S. PATENT DOCUMENTS

| | | | |
|---|---|---|---|
| 1,910,070 | 5/1933 | Spaeth | 251/323 X |
| 3,126,559 | 3/1964 | Alexander . | |
| 3,828,380 | 8/1974 | Lebovits | 441/21 |
| 4,034,693 | 7/1977 | Challenger . | |

*Primary Examiner*—Sherman D. Basinger

*Attorney, Agent, or Firm*—Lowe, King, Price & Becker

[57] ABSTRACT

A device for automatically raising fish traps, crayfish pots, nets and the like comprises a tank containing pressurized gas connected through a control valve to an inflatable bladder. A control unit including a receiver and a solenoid driver is operable to open the valve, causing bladder inflation, when activated by a signal transmitted through the water or a timing mechanism. The control unit and valve are located within a watertight compartment of a housing connected to the tank. A pair of substantially flat frame members interconnect the housing to the tank. The frame members are mutually orthogonal and include identical cutouts defining a spherical inflation region. The bladder is positioned in the inflation region by upper and lower mounting sleeves. The upper sleeve includes a deflation valve and lift ring to provide automatic bladder deflation as the ring is engaged by surface personnel to raise the device from the water.

16 Claims, 7 Drawing Figures

20
2
15
40a
72
10
68
70
40
74
12
24
28
66
22
2
62
11
60
29
42
33

20
79
55
82
78
4
4
57
57a
69
58
15
50
40
34
46
49
44
51
33c
48
33b
26
12
33b
28
42
48a
19
31
30
32
31a
17
33d
33a

BUOY DEVICE FOR AUTOMATIC RAISING OF SUBMERGED OBJECTS

TECHNICAL FIELD

This invention relates generally to devices for automatically raising submerged objects and, more particularly, to an inflatable and submergible buoy for automatically raising fish traps, crayfish pots, nets and the like.

BACKGROUND ART

Generally, crayfish, crab and lobster fishermen utilize traps that are baited and submerged to fish on an ocean or river bottom. Long lengths of hauling line connect the submerged trap to a float on the surface, marking the trap location. Periodically, a fishing vessel retrieves the traps, requiring extensive manual labor and time to haul in the lines to raise the traps. Since the float remains constantly on the surface, theft (of the traps or their contents) by other fishermen and scuba divers is often a serious and recurring problem.

To overcome this problem, submergible traps containing built-in automatic inflation devices are known, such as the type disclosed in U.S. Pat. No. 4,034,693 to Challenger, issued July 12, 1977. Such devices incorporate a buoyancy chamber containing an inflatable bladder engaged by trap members. A cylinder of compressed gas mounted on the trap is connected to a control valve to inflate the bladder. A control unit having a receiver or timing mechanism actuates the control valve upon detecting a signal transmitted through the water or after a predetermined time, causing the trap to ascend. A manual valve permits bladder deflation after the trap is hoisted on board.

While submergible traps incorporating automatic inflation means are generally effective to raise the trap to the surface, the automatic devices of which I am aware are not capable of use with other traps, since they are incorporated within and thereby dedicated to specific types of fishing traps. Further, if the automatic device malfunctions, the particular trap cannot be used until it is repaired, thereby reducing the potential catch.

The placement of a compressed gas cylinder and buoyancy chamber interconnected to the control unit by a pipe, as disclosed in the Challenger patent, occupies interior space, potentially reducing the number of crustaceans or fish that can be caught within the trap. Further, these parts are vulnerable to attack by claws of the crustaceans, possibly resulting in malfunction while bottom fishing and loss of the trap.

Upon surfacing, the buoyant chamber in the prior art trap device tends to partially raise the trap out of the water, causing disadvantageous exposure of the catch to air and sunlight. After the trap is hoisted aboard, a manual valve is opened to deflate the bladder. Since a relatively long time interval is required to completely deflate the bladder, as compared to the amount of time necessary to empty the contents of the trap, loss of valuable fishing time can often occur. Failure to close the manual valve after bladder deflation occurs can result in loss of the trap after it is thrown overboard.

It is accordingly an object of the present invention to provide a separate, submergible buoy that is releasably attachable to and capable of automatically raising to the surface submerged fish traps, pots, nets and the like.

Another object of the invention is to provide an automatic flotation buoy that can be used interchangeably with different types of traps and pots.

Another object of the invention is to provide a flotation buoy which allows an attached trap, when raised to the surface, to remain completely submerged until hoisted from the water.

Still a further object is to provide a flotation buoy having a device for automatically deflating the bladder while the buoy is being hoisted onto the deck of a fishing vessel.

Yet a further object is to provide an inflatable flotation buoy wherein a deflation valve means automatically closes following deflation.

Still another object is to provide a buoy that is compact and stable and which can be conveniently stored on board the fishing vessel.

DISCLOSURE OF INVENTION

A device for automatically raising fish traps, crayfish pots, nets and the like includes a tank containing gas under pressure. An inflatable bladder is interconnected to receive pressurized gas from the tank, causing the bladder to inflate and ascend to the water surface with the trap. A normally closed control valve interconnecting the tank and bladder can be opened to allow gas to pass from the tank to the bladder through suitable pressure conduits. Tie down rings secured to the tank permit the trap to be releasably attached to the buoy, enabling use of the buoy with different types of traps.

Preferably, the tank is square, formed from straight and elbow sections of circular pipe. A central housing includes a watertight compartment containing the control valve and a control unit having a receiver and timer mechanism operable to open the valve in response to a signal transmitted through the water, or after a predetermined time delay.

Each of a pair of orthogonally mounted, substantially flat frame members includes a lower base portion extending diametrically between opposite pipe sections, enabling connection of the housing to the tank. Each frame member projects upwardly from the tank and includes a large circular cutout defining a spherical inflation region which receives a vertical bladder. A pair of upper and lower mounting sleeves containing air passages communicate with the control valve. These sleeves are attached to the frame to receive and vertically support opposite ends of the bladder. An overinflation or pressure relief valve connected to the upper sleeve communicates with the bladder through the sleeve air passage to prevent overinflation as the buoy ascends.

The upper sleeve includes an enlarged bore extending upwardly and in communication with the sleeve air passage to define a valve seat. A deflation valve element attached to the lower end of a valve stem is slidably retained within the bore. The valve is urged downwardly against the valve seat by a spring to prevent deflation through the air passage and a discharge port formed in the bore. A lift ring attached to the upper end of the valve stem is manually engaged to lift the buoy and trap from the water, opening the deflation valve to automatically deflate the bladder.

Additional objects, advantages and novel features of the invention will be set forth in detail in part in the description which follows and in part will become apparent to those skilled in the art upon examination of the drawing, or may be learned by practice of the invention.

The objects and advantages of the invention may be realized and attained by means of the instrumentalities and combinations particularly pointed out in the appended claims.

BEST MODE FOR CARRYING OUT THE INVENTION

Figure 1:
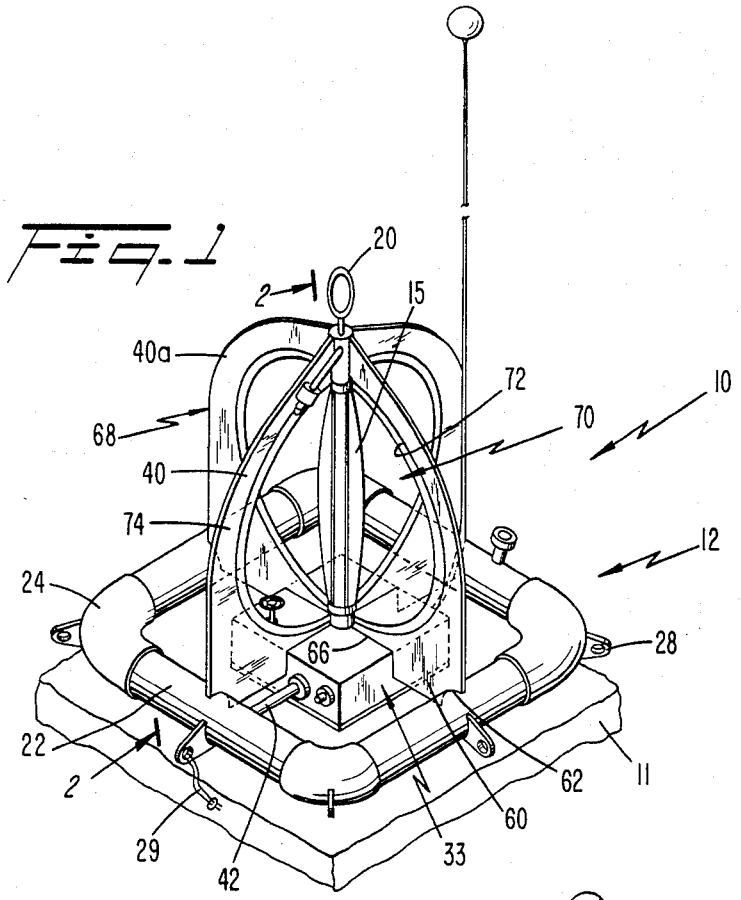
FIG. 1 is a perspective view of a submergible, automatic flotation device constructed in accordance with the present invention.
Figure 2:
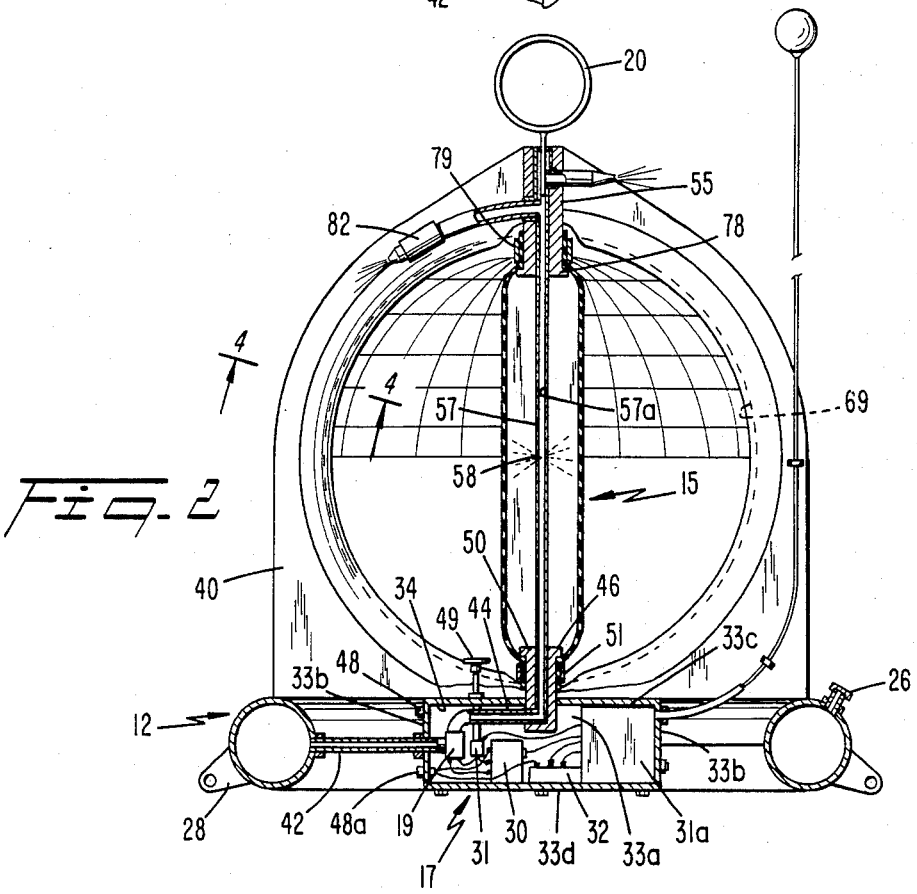
FIG. 2 is a sectional view taken along the line 2—2 of FIG. 1 illustrating the arrangement of the tank, housing and bladder units.
Figure 3:
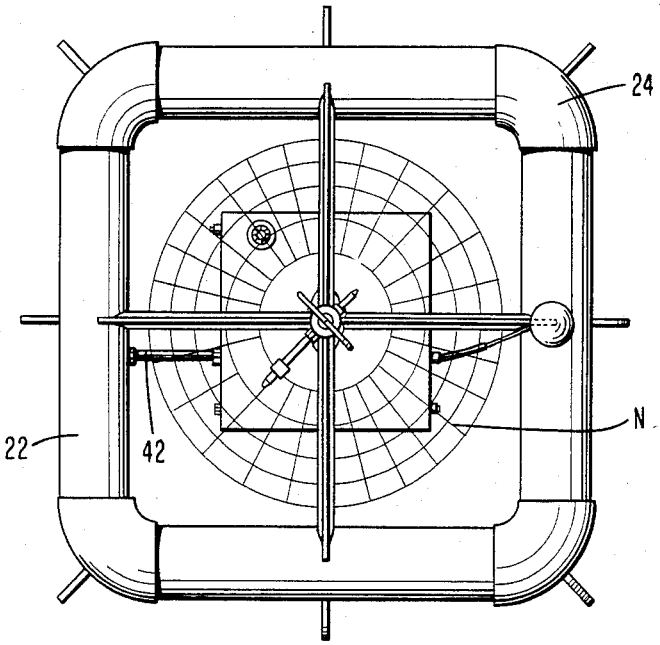
FIG. 3 is a top plan view of the device illustrated in FIG. 1.

Referring to FIGS. 1 and 2, a flotation buoy 10 for automatically raising submerged fish traps 11, crayfish pots, nets and the like comprises a tank 12 filled with compressed gas connected to an inflatable bladder 15 through a control unit 17. In response to an encoded signal through the water transmitted by a transmitter (not shown), control unit 17 activates a solenoid valve 19 to inflate bladder 15, enabling buoy 10 to automatically surface with trap 11. Once surfaced, bladder 15 rapidly deflates as lift ring 20 is grasped by personnel to lift buoy 10 from the water, enabling immediate reuse after the trap is emptied.

Tank 12 is preferably fabricated from straight sections of cylindrical pipe 22 interconnected with elbows 24 to provide a square configuration in plan view. The pipe sections 22, 24 can be, for example, steel or plastic pressure pipe of appropriate size and thickness to safely contain compressed air or $CO_2$ gas at predetermined volume and pressure levels, depending upon operating depths and the size of trap 11 desired to be raised. An externally mounted, high pressure air inlet valve 26 permits tank 12 to be charged with compressed gas using conventional compressor equipment. A plurality of circumferentially spaced tie-down rings 28 attached to the outer periphery of tank 12 enable trap 11 to be tied thereto with ropes 29.

Control unit 17 preferably includes a receiver 30, decoder 31, battery 31*a* and clock 32 coupled to operate solenoid valve 19 to admit air from tank 12 into bladder 15, as discussed more fully below. The receiver, decoder, battery and clock units 30–32 can be of the type disclosed in U.S. Pat. No. 4,034,693 to Challenger, incorporated herein by reference, and are preferably located within a pressure vessel housing 33, as illustrated in FIG. 1. Housing 33 includes parallel side walls 33*a*, end walls 33*b*, a top wall 33*c* and a bottom wall 33*d* attached to define a waterproof storage compartment 34 containing control unit 17. Compartment 34 is pressurized to withstand hydraulic pressures at a depth greater than that at which the control unit will normally operate.

Housing 33 is located centrally within the open region of tank 12 between pipe sections 22, 24. The sections 22, 24 protect control unit 17 from any direct impact with objects, as is likely to occur when buoy 10 is moved about on the fishing vessel before or after use. Orthogonally mounted frame members 40 and 40*a*, described infra, project upwardly from and between pipe sections 22, 24 to support bladder 15 and located housing 33 in the aforesaid position.

As best illustrated in FIG. 2, a pressure resistant conduit 42 extends between tank 12 through end wall 33*b* to supply compressed gas to the supply side of solenoid valve located within compartment 34. A second pressure resistant conduit 44 located within compartment 34 connects the delivery side of valve 19 to a cylindrical sleeve 46 projecting upwardly from top wall 33*c* to deliver gas to bladder 15. Sleeve 46 can be threaded to top wall 33*c* and sealed using O-rings (not shown in detail) to prevent water from leaking into compartment 34. An air inlet valve 48 and a battery charge terminal 48*a* are respectively provided within end wall 33*b* to respectively enable compartment 34 to be charged with air and to permit recharge of battery 31*a* prior to using buoy 10.

Sleeve 46 includes an annular lip 50 bulging outwardly from an upper portion thereof to anchor the lower end of bladder 15 to housing 33 with a ring clamp 51, as best shown in FIG. 2. Bladder 15, preferably formed from heavy duty rubber, is pleated to occupy a small volume when deflated. Bladder 15 extends upwardly from sleeve 46 between frame members 40, 40*a* and is secured at its upper end to a cylindrical sleeve 55 projecting downwardly from attachment to upper, intersecting portions of each frame member (see FIG. 1). A pressure line 57 having opposite ends received within sleeve 46, 55 respectively, extends within bladder 15, in communication with tank 12 through solenoid valve 19. The pressure line 57 includes a discharge orifice 58 communicating with the interior of bladder 15 to inflate the bladder when solenoid valve 19 is activated. A plunger operated microswitch 49 is provided to shut off the battery supply to the solenoid valve 19, thus shutting off the airflow from tank 12 when the bladder 15 is fully inflated. The microswitch 49 is actuated when the bladder 15 expands and exerts a downward pressure on the plunger.

Frames 40, 40*a* are preferably substantially flat, each frame having a lower base portion 60 extending diametrically between opposing pipe sections 22 and housing 33. Each base portion 60 includes a lower edge formed with a pair of semicircular end cutouts 62 and a central rectangular cutout 66. Cutouts 62, 66 permit each base portion 60 to fit and be secured to the contours of pipe sections 22 and housing 33 by welding or with mounting brackets (not shown) depending on the materials from which the frame, housing and pipes are constructed.

Figure 4:
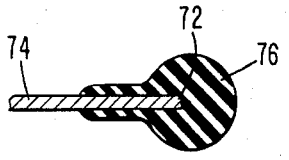
FIG. 4 is a sectional view taken along the line 4—4 of FIG. 2.

To affix bladder 15 within buoy 10, each frame 40, 40*a* respectively includes a flat upper portion 68 extending upwardly from base portion 60. Each upper portion 68 includes a centrally formed circular cutout 69 in which bladder 15 is located. Since upper portions 68 are mutually orthogonal, cutouts 69 define a spherical interior region 70 bounded by interior arcuate edges 72 of the upper portion whose total interior volume approximates the volume of bladder 15 when fully inflated. Peripheral portions 74 of upper portion 68 thereby protectively surround bladder 15 to prevent overinflation and to protect the bladder from possible rupture since inflation is limited by interior edges 72. Preferably, edges 72 are lined with a cushioning strip 76, such as rubber, to further minimize the likelihood of rupture of bladder 15 as it fully inflates (see FIG. 4).

The upper sleeve 55 is fixedly attached to intersecting parts of upper portion 68 and includes a lower lip 78 projecting downwardly into spherical region 70. As illustrated in FIG. 2, the upper end of bladder 15 is secured to lip 78 with a ring clamp 79 so that the bladder extends along the vertical central axis of buoy 10.

Figure 5:
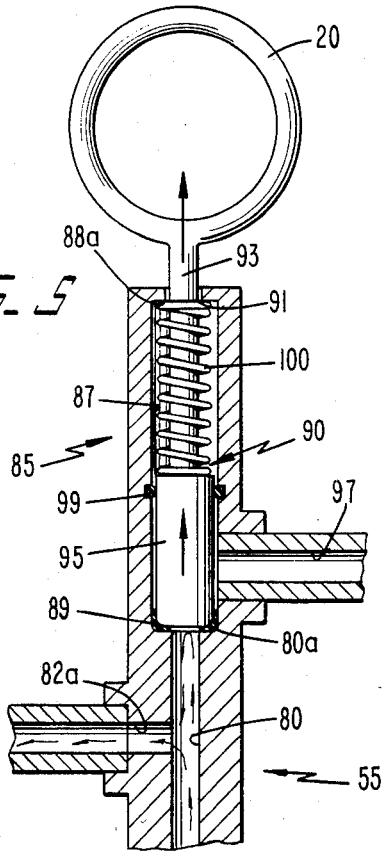
FIG. 5 is a partial, detailed view of a preferred form of automatic bladder deflation valve.

As illustrated in FIGS. 2 and 5, upper sleeve 55 includes a longitudinal air passage 80 receiving the upper end of pressure line 57. An overinflation or pressure relief valve 82 is connected to sleeve 55 and communicates with the interior of bladder 15 to discharge air through transverse bore 82*a* formed in the sleeve and air passages 57*a*, 80. Valve 82 is of conventional contruction and preset to prevent overinflation of bladder 15 by venting gas when a predetermined pressure level is exceeded.

In operation, fish trap 11 is baited and attached to buoy 10 via tie down rings 28 before the trap and buoy are dropped into the water, to sink to the bottom. When the fishermen returns to the same location, an encoded signal can be transmitted by placing a sonar signal generator (not shown) in the water. Receiver 30 picks up the encoded signal and, if the code sequence is correct as verified by decoder 31, solenoid valve 19 opens allowing gas to pass from tank 12 to bladder 15 through pressure conduits 42, 44, 57 and orifice 58. As bladder 15 inflates, buoy 10 becomes buoyant and rises to the surface with trap 11. During ascent, excess gas is discharged from buoy 10 through overinflation valve 82 in the manner described above. The symmetrical shape of buoy 10 and location of bladder 15 above tank 12 permit the buoy to surface and remain visible while maintaining trap 11 and its contents submerged beneath the buoy until the buoy is raised from the water by the surface personnel. In this manner, the contents of trap 11 advantageously remain in their natural environment, without exposure to sunlight and air, as often occurs with prior art flotation devices.

As mentioned supra, lift ring 20 projects upwardly above frames 40, 40*a* and is easily grasped by personnel to remove buoy 10 and trap 11 from the water. To automatically deflate bladder 15 while buoy 10 is being retrieved, the upper part of sleeve 55 functions as a valve casing 85, housing a spring loaded valve 90. As best illustrated in FIG. 5, casing 85 includes an elongated cylindrical bore 87 extending axially above and in communication with passage 80. Bore 87 has a larger diameter than passage 80, thereby defining a bottom end wall 80*a* facing upwardly to receive a valve seat 89. A top end wall 88*a* defines the top of bore 87 and includes a smaller diameter opening 91. A valve stem 93 extends upwardly through opening 91 for attachment to lift ring 20.

A valve element 95 is attached to the lower end of valve stem 93 to control discharge of gas from bladder 15 through air passage 80, bore 87 and an air discharge passage 97 communicating transversely with the bore. As illustrated in FIG. 5, valve 95 is cylindrically shaped and dimensioned to slide within bore 87, sealed to a stationary O-ring 99. A valve spring 100, carried by valve stem 93, presses against top wall 88*a* to urge valve 95 into a normally closed position against valve seat 89 to prevent deflation of bladder 15. Spring 100 is selected to have a compression force capable of maintaining valve 95 in a normally closed position against the counterpressure exerted on the valve underside by air within passage 80. However, by pulling up on lift ring 20, the compressive spring force is overcome, causing valve 95 to open.

Lift ring 20 and valve mechanism 95 of the present invention provide automatic deflation of bladder 15 while buoy 10 is being hoisted aboard the fishing vessel, advantageously enabling immediate reuse of the buoy as soon as the contents of trap 11 have been emptied. Furthermore, by deflating bladder 15 in the aforesaid manner, the likelihood of rupture of bladder 15 during handling or stowage on deck is minimized.

Figure 6:
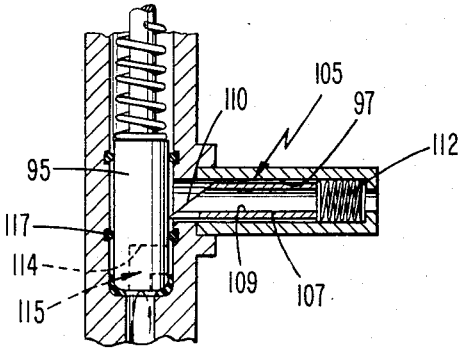
FIG. 6 is a detailed, partial sectional view of an alternative form of deflation valve means in a closed position.
Figure 7:
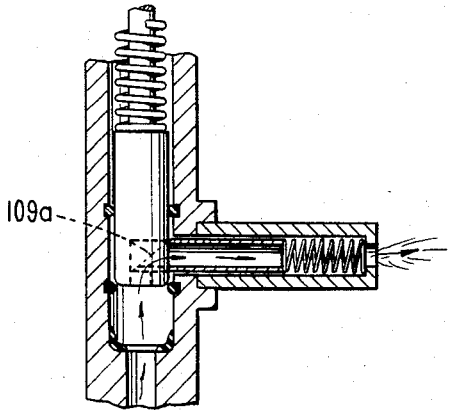
FIG. 7 is a view of the valve means illustrated in FIG. 6 in an open position.

FIGS. 6 and 7 illustrate an alternative, preferred embodiment of valve mechanism 95, wherein a spring loaded detent mechanism 105 maintains the valve open to ensure complete deflation of bladder 15. Detent 105 includes a hollow tubular member 107 positioned to slide within passage 97. Member 107 has an air discharge passage 109 with open opposite ends. The innermost end of member 107 includes an upwardly inclined face 110 biassed in the direction of valve 95 by a spring 112. When valve 95 is opened in the aforesaid manner, spring 112 urges innermost end 109*a* into a transverse air passage 114 of an L-shaped air passage 115 formed in the lower portion of valve 95, causing the valve to remain open to deflate bladder 15. Inclined surface 110 is tapered at a predetermined angle to prevent withdrawal of member 107 from passage 114 after ring 20 is released until a manual downward force is exerted on the ring. This manual force is transmitted to member 107 by the upper surface of passage 114 in sliding contact with inclined face 110, causing the member to withdraw from passage 115 to close the valve (see FIG. 6). An O-ring seal 117, positioned between transverse passage 114 and discharge passage 109 of member 107 (when valve 95 is closed) prevents fluid from entering air passage 80 while buoy 10 is submerged.

Retaining valve 95 in open position with detent mechanism 105 assures complete deflation of bladder 15 after a manual force is initially applied to ring 20 to lift the buoy into the fishing vessel. While in many instances complete deflation of bladder 15 can occur while buoy 10 is hoisted from the water prior to placement on the deck of the fishing vessel, in some circumstances, depending upon the bladder size and the method of removal from the water, only partial deflation will occur. Thus, detent mechanism 105 holds valve 95 open even after manual pressure on ring 20 is released. When the contents of trap 11 are emptied, a gentle manual downward pressure on ring 20 automatically closes valve 95 in the aforesaid manner so that buoy 10 is ready for immediate reuse.

The foregoing description of a preferred embodiment of the invention has been presented for purposes of illustration and description. It is not intended to be exhaustive or to limit the invention to the precise form disclosed. Obvious modifications or variations are possible in light of the above teachings. For example, netting N can be secured to inner edges 72 to surround bladder 15 while inflated, thereby assisting in confining the bladder to spherical region 70. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

I claim:

1. A submergible device for raising a load such as a fish trap, crayfish pot and the like to the surface of the water, comprising:

(a) a tank for containing gas under pressure;

(b) frame means establishing a volumetric chamber region in said device connected for receiving pressurized gas from the tank so that pressurized gas expanding into the chamber causes the device to ascend to the water surface with the load;

(c) control valve means for controlling gas flow between the tank and chamber, wherein said control valve means is contained within a housing;

(d) means for connecting the frame means to the housing, said connecting means including a sleeve like member having one end received in the housing and an opposite end connected to the frame means, said sleeve like member having a passage permitting gas to pass from the control valve means to the chamber region; and (e) means for releasably attaching the device to the load.

2. The device of claim 1, wherein said control valve means includes a normally closed solenoid valve to prevent gas from entering the chamber, and further including control unit means having a signal receiver and a signal decoder for opening the solenoid valve in response to a remote signal transmitted to the control unit means through the water, further including a timer means for opening said solenoid valve after a predetermined time interval has elapsed.

3. The device of claim 2, wherein said housing is a central housing mounted to said tank, said housing having a watertight compartment containing said solenoid valve and said control valve means.

4. The device of claim 3, wherein said chamber means is a bladder, and said frame means further includes a substantially flat frame member having a lower base portion extending diametrically between and connected to a pair of opposing pipe sections of said tank and an upper portion projecting above the tank, said upper portion including a circular cutout containing the bladder, and means connected to the frame for mounting said bladder within the cutout.

5. The device of claim 4, wherein said mounting means includes upper and lower sleeve members respectively attached to said upper frame portion and a top wall of the housing, said bladder having upper and lower ends respectively attached to said sleeve members, and a pressure conduit extending between the upper and lower sleeve members within the bladder, said lower sleeve member having an air passage connected to transmit pressurized gas from the tank to the pressure conduit, said conduit including an orifice for passing inflation gas into the bladder.

6. The device of claim 5, wherein an air passage is formed in a lower portion of said upper sleeve to communicate with the bladder, and further including relief valve means connected to the upper sleeve air passage in communication with the bladder, said relief valve being operable to vent pressurized gas from the bladder when a predetermined pressure level is exceeded.

7. The device of claim 6, wherein said upper sleeve further includes an upper portion integrally formed with the lower portion to define a valve casing, said valve casing having a cylindrical bore extending axially above and in communication with the upper sleeve air passage, said bore having a larger diameter than the passage to thereby define a bottom end wall facing upwardly to receive a valve seat of a deflation valve, said deflation valve including a cylindrical valve element having a spring means urging the valve element into a normally closed position against the valve seat to prevent bladder deflation from the upper sleeve air passage to a discharge opening formed in the upper sleeve above the passage, said valve means further including a valve stem carrying said spring means and interconnecting the valve element to the lift ring, application of a lifting force on the lift ring thereby causing said valve element to open and deflate said bladder.

8. The device of claim 7, wherein said valve means further includes detent means located within the discharge opening for engaging and retaining said valve element open, to thereby permit complete deflation of said bladder when the lift ring is engaged to open said deflation valve means, said detent mechanism being operable to disengage from the valve element when a closing force is applied to the lift ring to thereby close the valve.

9. The device of claim 1, wherein said chamber is formed within an inflatable bladder, and further including a lift ring attached to the device and engageable by personnel to raise the device and load it into a fishing vessel or the like, and a deflation valve means connected to the lift ring and actuatable for automatically deflating said bladder when said lift ring is engaged.

10. The device of claim 1, wherein said tank has a square configuration.

11. The device of claim 5, wherein said tank includes pairs of substantially straight sections of circular pipe interconnected by elbow pipe sections.

12. A submergible buoy comprising:

(a) a tank for containing gas under pressure;

(b) an inflatable bladder connected to receive pressurized gas from the tank, causing the bladder to inflate to thereby raise the submerged buoy to the water surface;

(c) control valve means for controlling gas flow from the tank to the bladder;

(d) a pair of substantially flat, mutually orthogonal frame members having lower portions connected to the tank, each frame member including a cutout defining a substantially spherical region between the frame members, and means for connecting opposite ends of the bladder to upper and lower ends of the frame members with the bladder occupying said said spherical region and being protected from impact with external objects by said frame members;

(e) control unit means for selectively opening (f) a lift ring connected to said frame members to enable the buoy to be lifted out of the water by personnel; and (g) deflation valve means operatively connected to said bladder and said lift ring for automatically deflating said bladder when said lift ring is engaged to lift the buoy.

13. A submergible device for automatically raising submerged objects to a water surface, comprising:

(a) supply means for containing pressurized gas;

(b) means having a buoyancy chamber connected for receiving pressurized gas from the pressurized gas supply means so that gas expanding into the chamber causes the device to ascend;

(c) valve means connected to the supply means for admitting gas under pressure into said chamber; and (d) means for coupling said device to a lifting means to enable the device to be lifted from the water after said device ascends to the surface, said coupling means including a normally closed deflation valve means operable to automatically open and thereby cause rapid exhaustion of gas from the chamber when a lifting force is applied to the coupling means.

14. A submergible device for raising a load such as a fish trap and the like to a water surface, comprising a tank for containing gas under pressure; an inflatable bladder connected to receive pressurized gas from the tank, causing the bladder to inflate and thereby ascend to the water surface with the load; control valve means for controlling gas flow between the tank and bladder; frame means connected to the tank and including a cutout defining a region in which the bladder extends and is protected from impact with external objects by said frame means; and means for mounting said bladder within the frame means, said mounting means including upper and lower sleeve members respectively attached to a portion of the frame means and a housing containing the control valve means, said bladder having upper and lower ends respectively attached to said sleeve members, and a pressure conduit extending between the upper and lower sleeve members within the bladder, said lower sleeve member having an air passage connected to transmit pressurized gas from the tank to the pressure conduit, said conduit including an orifice for passing inflation gas into the bladder.

15. A submergible buoy comprising:

(a) a tank for containing gas under pressure;

(b) an inflatable bladder connected to receive pressurized gas from the tank, causing the bladder to inflate to thereby raise the submerged buoy to the water surface;

(c) control valve means for controlling gas flow from the tank to the bladder;

(d) a pair of substantially mutually orthogonal frame members connected to the tank, said frame members establishing a substantially spherical region therebetween, and means for connecting opposite ends of the bladder to upper and lower ends of the frame members with the bladder occupying said spherical region and being protected from impact with external objects by said frame members; and (e) control unit means for selectively opening the valve means to thereby inflate the bladder.

16. A submergible device for raising a load such as a fish trap and the like to a water surface, comprising a tank for containing gas under pressure; an inflatable bladder connected to receive pressurized gas from the tank, causing the bladder to inflate and thereby ascend to the water surface with the load; control valve means for controlling gas flow between the tank and bladder; frame means connected to the tank for defining a region between the frame means in which the bladder extends and is protected from impact with external objects by said frame means; and means for mounting said bladder within the frame means, said mounting means including upper and lower sleeve members respectively attached to a portion of the frame means and a housing containing the control valve means, said bladder having upper and lower ends respectively attached to said sleeve members, and a pressure conduit extending between the upper and lower sleeve members within the bladder, said lower sleeve member having an air passage connected to transmit pressurized gas from the tank to the pressure conduit, said conduit including an orifice for passing inflation gas into the bladder.

* * * * *